United States Patent [19]

Baker

[11] Patent Number: 4,801,088

[45] Date of Patent: Jan. 31, 1989

[54] PORTABLE BATTERY POWERED SPRAYER

[76] Inventor: Wesley L. Baker, 615 Grover St., Liberty, Mo. 64068

[21] Appl. No.: 59,638

[22] Filed: Jun. 8, 1987

[51] Int. Cl.[4] ..... B05B 9/08

[52] U.S. Cl. ..... 239/152; 239/332; 222/175; 222/333; 222/385

[58] Field of Search ..... 239/152, 153, 154, 332; 222/175, 333, 385

[56] References Cited

U.S. PATENT DOCUMENTS

| | | | |
|---|---|---|---|
| 3,726,443 | 4/1973 | Harris | 222/385 |
| 3,904,116 | 9/1975 | Jones et al. | 222/333 |
| 4,618,099 | 10/1986 | Nagao et al. | 239/332 |
| 4,621,770 | 11/1986 | Sayen | 239/332 |

FOREIGN PATENT DOCUMENTS

| | | | |
|---|---|---|---|
| 2055868 | 5/1972 | Fed. Rep. of Germany | 239/152 |
| 3127300 | 1/1983 | Fed. Rep. of Germany | 239/332 |
| 3439388 | 4/1986 | Fed. Rep. of Germany | 239/332 |

*Primary Examiner*—Andres Kashnikow
*Assistant Examiner*—Karen B. Merritt
*Attorney, Agent, or Firm*—Kokjer, Kircher, Bradley, Wharton, Bowman & Johnson

[57] ABSTRACT

A pump driven portable sprayer powered by rechargeable batteries. The pump and batteries are housed in a rigid pipe which is threaded onto a liquid tank in extension through a fill opening of the tank. Extending from the pipe is a flexible hose which carries a spray wand on its end. A cap on the pipe is equipped with electrical connections for a battery charger and for alternative power sources such as an AC adapter, a vehicle cigarette lighter adapter or a portable battery pack.

1 Claim, 1 Drawing Sheet

PORTABLE BATTERY POWERED SPRAYER

BACKGROUND AND SUMMARY OF THE INVENTION

This invention relates generally to spraying equipment and more particularly to a portable sprayer which is powered by a rechargeable battery.

Pump sprayers have long been used to spray liquids of various types such as pesticides and herbicides or concentrate detergent for washing vehicles. Typically, the sprayer includes a tank equipped with a hand operated pump which is used to supply the pressure necessary to deliver the liquid to a hand held wand used for application of the liquid. The major problem with this type of device is that considerable time and effort is required to manually operate the pump from time to time.

Accordingly, it is apparent that a need exists for a sprayer that does not require manual pumping. The present invention is aimed primarily at providing such a sprayer.

More specifically, the invention is directed to a portable sprayer having a pump which is operated by the electrical power supplied by a rechargeable battery. In accordance with the invention, a portable tank holds the liquid that is to be sprayed and may be equipped with straps allowing it to be strapped onto the back or over the shoulder. A submersible pump is housed in a cylindrical pipe which is immersed in the liquid in the tank. Rechargeable batteries are housed within the pipe and supply the electrical power necessary to operate the pump. The pump delivers the liquid through a hose which carries a spray wand on its end. An on-off switch or in line pressure type switch for the pump is located on the handle of the spray wand along with a trigger operated valve which controls the liquid flow to a discharge nozzle located on the tip of the wand.

A battery charger is provided in order to permit the batteries to be recharged when drained. If the sprayer is to be used in the vicinity of an electrical outlet or other source of AC power, an AC adapter may be connected with the sprayer in order to avoid draining the batteries. Likewise, power may be supplied from a vehicle battery by plugging an adapter into the vehicle cigarette lighter. As still another alternative source of power, a separate battery pack may be connected to supply the operating power for the pump. The battery pack may be portable and carried on a belt or elsewhere on the person, thus retaining the portable character of the sprayer and providing extended spraying time due to the presence of the additional battery.

It is an important feature of the invention that the spray wand, hose, pump and batteries are constructed as a single unit which may be threaded into the tank and unthreaded to inspect the pump or batteries or to allow the tank to be filled with additional liquid. This unitary construction facilitates maintenance while at the same time simplifying the sprayer and minimizing the number of parts.

DETAILED DESCRIPTION OF THE INVENTION

Figure 1:
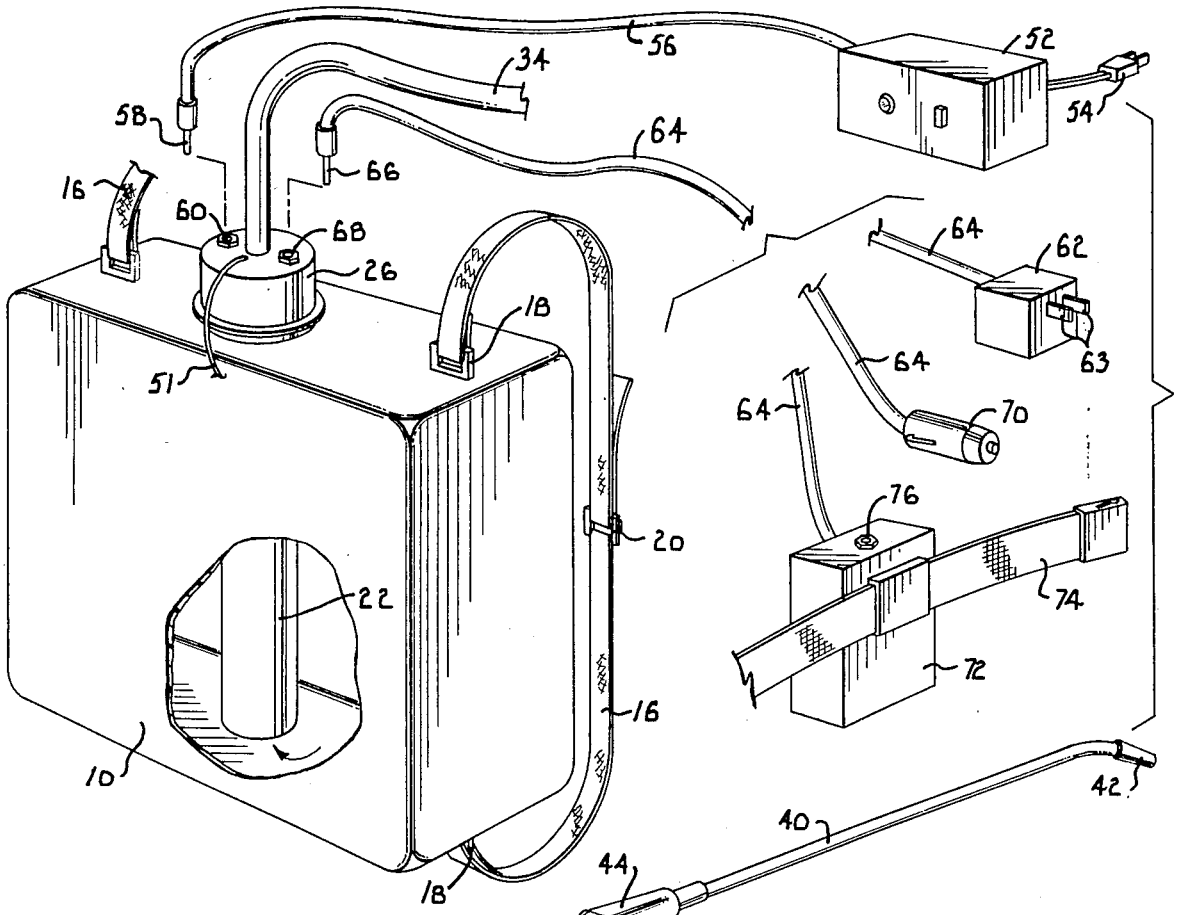
Figure 2:
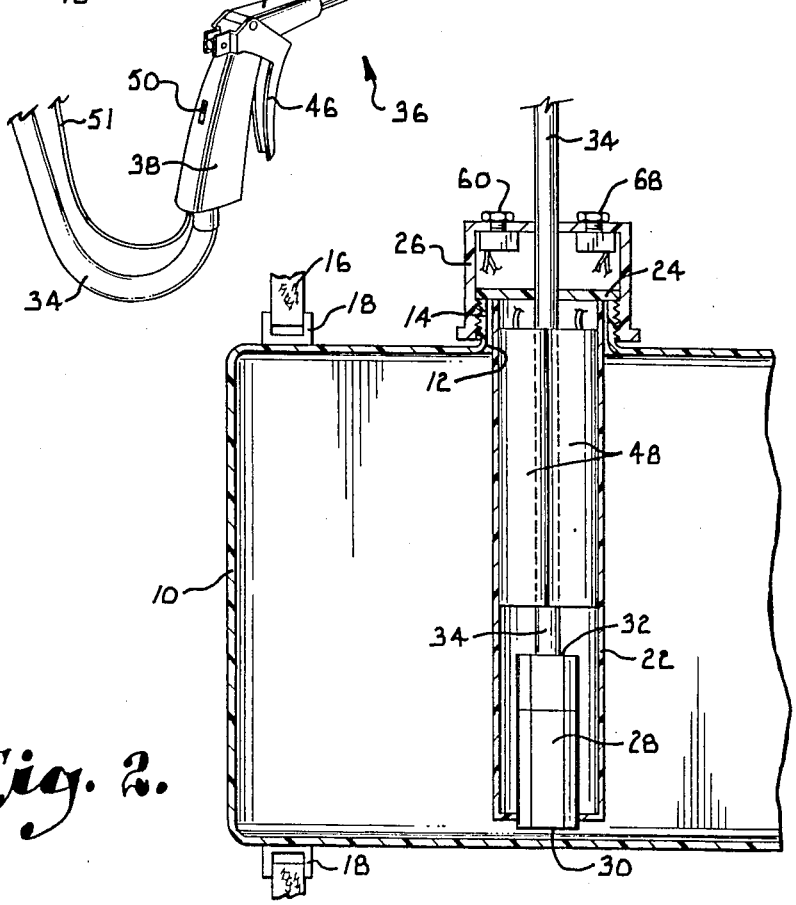

In the accompanying drawing which forms a part of the specification and is to be read in conjunction therewith and in which like reference numerals are used to indicate like parts in the various views:

FIG. 1 is a perspective view of a portable sprayer constructed according to a preferred embodiment of the present invention, with the break lines indicating continuous length and portions broken away for illustrative purposes; and FIG. 2 is a fragmentary sectional view taken through the spray tank on a vertical plane.

Referring now to the drawing in more detail, numeral 10 designates a portable tank which holds various types of liquid that are to be sprayed. The tank 10 is illustrated as being generally rectilinear, although it may take on virtually any shape including the more conventional cylindrical shape. In any event, the tank 10 is leak proof and includes a fill opening 12 in its top. Extending around the fill opening 12 is an upturned neck 14 which is generally cylindrical and which is provided with external threads. The tank 10 may be constructed of plastic or any other suitable material which is relatively light in weight in order to permit the tank to be carried on the person.

A pair of flexible straps 16 are connected to rings 18 on the top and bottom of the sprayer and are equipped with buckles 20 to permit adjustment of the length of each strap. The provision of the straps 16 permits the sprayer to be strapped onto the back or over the shoulder of the person using it.

Extending into the interior of tank 10 through the fill opening 12 is a hollow pipe 22 which forms a shell in which various components of the sprayer are housed. The top end of pipe 22 is covered by a plate 24 which is in turn connected with a generally cylindrical cap 26. The cap 26 is internally threaded in order to mate with the external threads on neck 14, and this threaded connection supports pipe 22 in extension within tank 10. It is noted that the lower end of pipe 22 is located adjacent to the bottom of the tank. It is also noted that the cap 26 can be unthreaded from neck 14 to permit removal of pipe 22 and its internal components for inspection and/or maintenance. This at the same time exposes the fill opening 12 so that additional liquids can be inserted into the tank 10. It should be noted that another opening may be provided in the top of the tank to facilitate filling a tank through a screen.

Mounted within pipe 22 is a submersible electric pump 28 having an intake 30 projecting below the lower end of pipe 22 at a location immersed within the liquid contained in tank 10. The pump intake 30 is located adjacent to the floor of tank 10 in order to accommodate pumping of virtually all of the liquid contained in the tank.

Pump 28 has a discharge side 32 which connects with an elongate hose 34 which extends through pipe 22 and through plate 24 and the cap 26. Since the hose 34 connects with the discharge side of pump 28, the liquid which is delivered by the pump is forced through the hose to a spray wand which is generally identified by numeral 36 in FIG. 1. The wand 36 has a handle 38 which is suitable for gripping in the hand and which connects with the end of hose 34. A pipe 40 extends from handle 38 and carries on its tip a spray nozzle 42 which is located remotely of the handle 38. The nozzle 42 operates to spray the liquid which is applied to the wand 36. The flow of liquid from the handle 38 to the pipe 40 is controlled by a valve 44 which is mounted on the handle 38 and operated by a trigger 46. When the trigger is squeezed toward handle 38, valve 44 is opened to permit the liquid to flow to the pipe 40 and nozzle 42. When the trigger is released, it moves away from handle 38 to close the valve 44, thereby blocking flow from the handle of the wand to the spray tip.

Electrical power for operating pump 28 is normally supplied by a plurality of rechargeable batteries 48 which are housed within the upper portion of pipe 22. The batteries are electrically connected with the pump 28 and with an on-off slide switch 50 (FIG. 1) located on the handle 38 of the spray wand. An in line pressure switch may be used in place of the slide switch. Switch 50 is in the electrical circuit which includes the batteries and pump and completes the circuit to energize pump 28 when the switch is in the on position. In the off position of switch 50, the pump circuit is interrupted and the pump is deenergized. An electrical wire 51 extends generally along hose 34 from cap 26 to the handle 38 in order to toute the electrical circuit through switch 50.

The batteries 48 provide direct current power which operates the submersible pump 28. The batteries 48 may be nickel cadmium batteries or any other type of battery which can be recharged when its charge has been drained. As shown in FIG. 1, a battery charger 52 is provided to permit recharging of the batteries 48. The battery charger is provided with a plug 54 which may be connected with a conventional AC power outlet. Also extending from the battery charger 52 is a conductor 56 which provides rectified power for recharging of the batteries. The end of plug 56 carries a pin type connector 58 which may be inserted into a socket 60 in the cap 26. The socket 60 is electrically connected with the batteries 48 such that it applies a charge thereto when the battery charger is connected with an AC power source and the pin 58 is inserted in socket 60. Charging of the batteries takes place in a conventional manner.

In use, the sprayer is normally strapped on the back of the person who is applying the liquid, and the wand is held in one hand by its handle 38. When switch 50 is moved to the on position, the pump 28 is activated and draws liquid from the tank into its intake side 30 and pumps it through its discharge side 32 through the flexible hose 34. The liquid that is thereby delivered to the spray wand 36 may be sprayed by squeezing of trigger 46 in order to open valve 44. The liquid is then discharged through the spray nozzle 42 and onto the object or objects being sprayed. The liquid spray can be cut off by releasing the trigger 46, thus resulting in closing of the valve 44. When the sprayer is not in use, switch 50 is normally in the off position to deactivate the pump 28. When the batteries 48 have been drained, they can be recharged by connecting the battery charger 52 in the manner described previously.

As an alternative to using the batteries 48 to supply power to drive the pump 28, an AC adapter 62 is provided. If the sprayer is to be used in proximity to an electrical outlet or other source of AC power, the adapter 62 can be plugged into the outlet by inserting its prongs 63 into the slots of the electrical outlet. Extending from the adapter is an electrical line 64 which supplies rectified DC current to a pin connector 66 carried on the end of line 64. The pin connector 66 may be inserted into a socket 68 on the cap 24. Socket 68 is electrically connected with the pump and switch 50 and can be used to supply the operating power to the pump instead of the batteries 48. Again, switch 50 is used to activate and deactivate the pump. It should be noted that the AC adapter 62 is practical for use only when the tank 10 is to be operated in a relatively stationary position since the length of the electrical line 64 limits where the tank can be located.

As another alternative power source, a vehicle cigarette lighter adapter 70 is provided. The cigarette lighter adapter 70 has a size and shape to fit within a vehicle cigarette lighter and thus receive power from the automobile battery. This power is delivered to line 64 and to the pin connector 66 which may be plugged into the socket 68 in order to electrically connect the vehicle battery with the pump 28, thereby making use of the vehicle battery for operation of the pump. It is again to be noted that the cigarette lighter adapter 70 is useful only when the tank 10 is to be used in relatively close proximity to one or more vehicles.

As still another alternative source of electrical power, a portable battery pack 72 is provided. The battery pack 72 may be carried on a belt 74 or elsewhere on the person. Extending from the battery pack is the line 64 which carries connector 66. Thus, connector 66 may be plugged into socket 68 in order to connect the portable battery pack 72 with pump 28 in order to power the pump in place of the built in batteries 48. It is noted that the portability of the battery pack 72 allows the sprayer to be used at virtually any location and thus allows the sprayer to retain its portable character. At the same time, the provision of the battery pack 72 allows the sprayer to be used at a remote location even if the built in batteries 48 are depleted of charge. It is noted that the battery pack 72 includes a socket 76 which may receive the pin connector 58 extending from the battery charger 52, thus allowing the battery pack 72 to be recharged.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. A portable spraying device for spray application of liquids, said device comprising:

a portable tank adapted to hold liquids to be sprayed and having a size and weight to be carried on the person, said tank having a bottom and a top presenting a fill opening through which liquids may be supplied to the tank;

a spray wand adapted to be held in the hand, said wand having a discharge nozzle for spraying liquids delivered to the wand;

a pipe presenting a liquid tight chamber therein and having a length to extend from said fill opening to a location adjacent the bottom of the tank, said pipe having a top end carrying a cap thereon;

means for establishing a threaded connection between said cap and tank for holding said pipe in extension through the fill opening in a manner to submerge the pipe in the liquid in the tank, said threaded connection permitting removal of said pipe from the tank to expose the fill opening;

a battery powered pump mounted in said chamber in the pipe, said pump having an intake side situated outside of the chamber adjacent the bottom of the tank at a location to draw in liquid from the tank and a discharge side located with said chamber;

a rechargeable battery pack mounted in said chamber above the pump and electrically coupled with said pump to supply electrical operating power thereto;

an elongate flexible hose having an inlet end connected with said discharge side of the pump at a location within said chamber, said hose extending in said chamber and through said cap and connecting with said wand to deliver liquid thereto when the pump is activated;

switch means for activating and deactivating said pump;

a battery charging terminal on said cap for connection with a battery charger for charging of the battery; and said pipe being removable to remove the pipe, pump, battery pack and hose as a unit from the tank.

* * * * *